US011603276B2

(12) United States Patent
Chesaux et al.

(10) Patent No.: US 11,603,276 B2
(45) Date of Patent: Mar. 14, 2023

(54) GRIPPER BAR BODY FOR A GRIPPER CARRIAGE ARRANGEMENT

(71) Applicant: BOBST MEX SA, Mex (CH)

(72) Inventors: Stephane Chesaux, Echallens (CH); Jean-Claude Rebeaud, Le Mont-sur-Lausanne (CH)

(73) Assignee: BOBST MEX SA, Mex (CH)

( * ) Notice: Subject to any disclaimer, the term of this patent is extended or adjusted under 35 U.S.C. 154(b) by 0 days.

(21) Appl. No.: 17/255,390

(22) PCT Filed: Jul. 4, 2019

(86) PCT No.: PCT/EP2019/025212

§ 371 (c)(1),
(2) Date: Dec. 22, 2020

(87) PCT Pub. No.: WO2020/011395

PCT Pub. Date: Jan. 16, 2020

(65) Prior Publication Data

US 2021/0261366 A1 Aug. 26, 2021

(30) Foreign Application Priority Data

Jul. 11, 2018 (EP) ..... 18020327

(51) Int. Cl.
*B65H 5/14* (2006.01)

(52) U.S. Cl.
CPC ..... *B65H 5/14* (2013.01)

(58) Field of Classification Search
CPC ..... B65H 5/14
See application file for complete search history.

(56) References Cited

U.S. PATENT DOCUMENTS 4,111,123 A 9/1978 Willeitner
4,155,305 A 5/1979 Heissler et al.
(Continued)

FOREIGN PATENT DOCUMENTS

CN 104074849 A 10/2014
DE 102010003863 * 10/2011
(Continued)

OTHER PUBLICATIONS

International Search Report dated Oct. 8, 2019, in counterpart International Patent Application No. PCT/EP2019/025212 (2 pages).

*Primary Examiner* — Thomas A Morrison
(74) *Attorney, Agent, or Firm* — Bookoff McAndrews, PLLC

(57) ABSTRACT

The invention relates to a gripper bar body for a gripper bar in a gripper carriage arrangement in a machine for treating sheet material, the gripper bar body being configured to carry gripper brackets for movement between sheet gripping and sheet releasing positions. The gripper bar body is formed as a hollow structure comprising at least two different materials, the two different materials comprising at least a metal material and a composite material and the at least two different materials being at least partly arranged in a superposed manner. The resulting bar has a better resistance to wear than the ones of the state-of-the-art.

20 Claims, 1 Drawing Sheet

(56) References Cited

U.S. PATENT DOCUMENTS

| | | | | |
|---|---|---|---|---|
| 4,305,903 | A * | 12/1981 | Krause | B29C 70/081 264/258 |
| 5,125,640 | A | 6/1992 | Yerly et al. | |
| 6,752,392 | B2 | 6/2004 | Fricke et al. | |
| 9,103,373 | B1 * | 8/2015 | Kolar | E05F 1/1091 |
| 2002/0106257 | A1 * | 8/2002 | Braun | F16B 35/06 411/353 |

FOREIGN PATENT DOCUMENTS

| | | | |
|---|---|---|---|
| EP | 2017080 | A2 | 1/2009 |
| GB | 2101164 | A | 1/1983 |
| JP | S52101106 | A | 8/1977 |
| JP | H4226234 | A | 8/1992 |
| JP | 2004014301 | A | 1/2004 |
| JP | 2009023843 | A | 2/2009 |
| JP | 2009179001 | A | 8/2009 |
| RU | 2375195 | C2 | 12/2009 |
| SU | 1082623 | A1 | 3/1984 |
| SU | 1664584 | A1 | 7/1991 |
| WO | WO 2004/103652 | A2 | 12/2004 |
| WO | 2017178437 | A1 | 10/2017 |

* cited by examiner

GRIPPER BAR BODY FOR A GRIPPER CARRIAGE ARRANGEMENT

CROSS-REFERENCE TO RELATED APPLICATION(S)

This application is a National Stage under 35 U.S.C. § 371 of International Application No. PCT/EP2019/025212, filed on Jul. 4, 2019, which claims priority to European Patent Application No. 18020327.5, filed on Jul. 11, 2018, the contents of all of which are incorporated by reference in their entirety.

TECHNICAL FIELD

The invention relates to a gripper bar body for a gripper carriage arrangement in a machine for treating sheet material.

BACKGROUND OF THE INVENTION

Gripper bars are for example used in machines for treating plate-shaped matter or sheets into packages, like for example printing or converting. In these machines the gripper bar enables the pulling and positioning of the sheets as they are carried through various sequences of printing, cutting, embossing, creasing and/or waste-stripping stations.

Gripper bars usually comprise a body structure to which gripper means are attached, like for example brackets. These brackets can be closed to grip a sheet and opened to release the same.

Gripper bars are usually fitted on two lateral chains at regular distances and extend crosswise to the travelling direction of the plate-shaped sheets. Inside the machine, the chains having the bars follow a circuit initially composed by successive horizontal translational movement from a starting position along a substantially horizontal path through the various processing stations and then, at the end of the path, move in an upward arc to a return path which then terminates in a downward curved arc to the starting position for the path extending through the stations. When the bar is in the starting position, it is aligned with the stops of a feeder table. At this stage, the grippers are opened by a control device which, depending on the structure of the machine, can be either an integral part of the gripper bar or a separate element of the machine.

When a subsequent piece of a sheet of material is pushed onto the feeder table toward the front stops with the leading edge being moved between the lower gripper counterparts and the upper pressing fingers of the open grippers, the gripper opening mechanism will then be actuated in a reverse direction in such a way that the new plate-shaped piece will be gripped in order to be carried to the first processing station in the course of the first translational movement of the gripper bar along the path between the stations. In view of the fact that in every processing station the plate-shaped pieces are to be stopped in order to allow the accomplishment of the corresponding cutting, waste-stripping and similar operations, the pieces are to be transferred from one station to the other as commanded by the successive translation composed of a combination of an acceleration, a deceleration, and either a dwell or a standstill.

Since the bars are connected only at their ends, the bending and torsional stresses applied to the bars by the acceleration and deceleration is readily evident. Therefore, these gripper bars should have sufficient sturdiness to prevent major deformation.

Further, it can also happen that during the use of a machine, the gripper bar body structure can be damaged by the product to be processed and/or the tool, necessary for processing.

In case this part is changing, it might be that the material starts to deform, which can lead to a kind of a "crash" of the gripper bar.

In U.S. Pat. No. 4,155,305, a gripper carriage is disclosed made of carbon fibers with a hard foam core. The carbon fibers are used to give sturdiness to the gripper bar.

It is, therefore, an object of the invention to overcome drawbacks of the gripper bars used in the prior art.

SUMMARY OF THE INVENTION

According to one aspect, the invention relates to a gripper bar body for a gripper bar in a gripper carriage arrangement in a machine for treating sheet material, the gripper bar being configured to carry gripper brackets for movement between sheet gripping and sheet releasing positions. The gripper bar is formed as a hollow structure comprising at least two different materials, the two different materials comprising at least a metal material and a composite material and the at least two different materials being at least partly arranged in a superposed manner. Further, the gripper bar comprises at least two areas of superposed materials.

According to another aspect the invention related to a gripper carriage arrangement comprising a gripper bar body according to the invention.

DESCRIPTION OF THE INVENTION

The invention relates to a gripper bar body for a gripper bar in a gripper carriage arrangement in a machine for treating sheet material. The gripper bar body is being configured to carry gripper brackets for movement between sheet gripping and sheet releasing positions. The gripper bar body is formed as a hollow structure comprising at least two different materials, the two different materials comprising at least a metal material and a composite material. According to the invention the at least two different materials are at least partly arranged in a superposed manner, and the gripper bar body comprises at least two areas of superposed materials.

A gripper bar body to be used in gripper bar according to the invention shows the advantage, that the area showing the composite material is protected by this material. Further to this, by superposing the materials as described, the rigidity of the gripper bar body may be enhanced.

Advantageously, where the metal and composite material are superposed, the composite material is located on the outside of the hollow structure, whereas the metal material is located on the inside of the hollow structure.

Advantageously, the composite material may be chosen to have a higher abrasion resistance than the metal material, thereby protecting the material from scratches or impacts. Scratches or impact may affect the gripper bar solidity and may lead to fracture of the gripper bar. In particular, the composite material protects the underlying metal from repeated impacts, that tend to repeatedly happen at the same location on the gripper while the bar runs in loops in the machine. A better abrasion resistance results in better resistance to wear or the gripper bar as a whole.

Good results could be achieved when, according to a preferred embodiment, the two areas are at least in substantially opposing areas of the hollow structure. Usually, these areas are at risk of being damaged. Also in terms of rigidity, such an arrangement of the two areas may lead to positive results According to another preferred embodiment, the two areas extend substantially along the entire width of the gripper bar.

Good results could be achieved when areas for engaging the gripper bar body are omitted from superposing. The superposed material might lead to different properties with regards to screwing to connect parts, etc. Therefore, positive results could be received when these areas are omitted from superposing. Also, omitting these areas from superposing eases the manufacturing of the gripper bar and positively affects its production cost.

According to yet another embodiment of the invention, the metal material comprises at least one of aluminum, magnesium and/or titanium. These materials have good properties with regards to machinability and/or weight.

Good results could be achieved if the composite material comprises at least a fiber composite material, preferably at least one of carbon fiber reinforced, glass fiber reinforced, aramid fiber reinforced, natural fiber reinforced and/or wood fiber reinforced plastic.

If the fibers of the fiber composite material are arranged substantially in a direction parallel to the angle of the profile, good mechanical properties of the gripper bar could be achieved. The direction parallel to the angle of the profile is perpendicular to the motion of the gripper bar when the gripper bar is used in a running conversion machine.

According to another preferred embodiment of the invention, the fibers of the fiber composite material are arranged in at least two directions, preferably substantially perpendicular directions.

According to yet another preferred embodiment of the invention, the hollow structure of the gripper bar body is a substantially quadrangular shaped structure with rounded angles and whereas the at least two areas comprise parts of longitudinal areas. Such a geometry of the structure was found to be a cost effective solution showing high surface inertia with a low height.

The composite material may be attached to the metal material by any mechanical, chemical and physical means known in the prior art. Good results could be achieved by gluing the composite material to the metal material. Herefore a glue on the basis of epoxy, acrylic, methacrylate, polyurethane, polymer, etc. can be used.

Preferably the gripper bar body according to the invention is comprised in a gripper carriage arrangement.

BRIEF DESCRIPTION OF THE DRAWINGS

The invention will now be explained with reference to several embodiments, which are shown in the attached drawings. In the drawings.

DETAILED DESCRIPTION OF POSSIBLE EMBODIMENTS OF THE INVENTION

This section describes in details some possible variations for implementing the invention followed by specific examples of embodiments.

Figure 1:
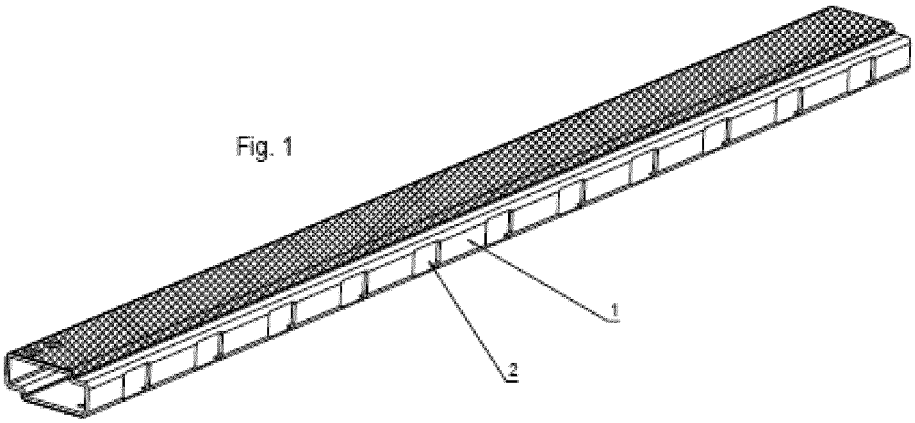
FIG. 1 shows a three-dimensional view of a gripper bar body according to a preferred embodiment of the invention.
Figure 2:
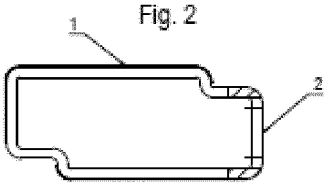
FIG. 2 shows a cross section of a gripper bar body according to a preferred embodiment of the invention.

In FIG. 1 a three-dimensional view of a gripper bar body (1) according to a preferred embodiment of the invention is shown. FIG. 2 shows a cross-section thereof. The bar body is configured to carry gripper brackets, which might be engaged with the gripper bar body at predefined positions (2) for movement between sheet gripping and sheet releasing positions. According to this preferred embodiment, the gripper bar body is formed as an entirely hollow structure. According to the embodiment of the invention presented in FIGS. 1 and 2, the hollow structure of the gripper bar body (1) is a substantially quadrangular shaped structure with rounded angles.

Figure 3A:
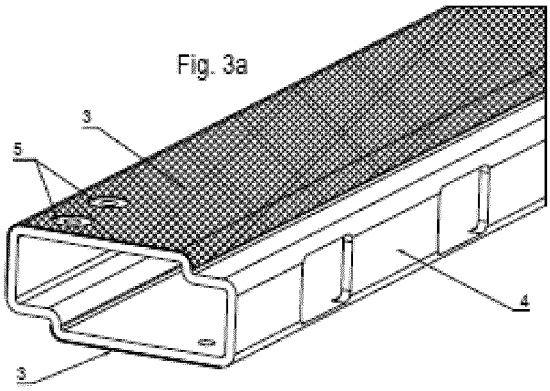
FIG. 3 *a* and *b* shows different three-dimensional views of a gripper bar according to a preferred embodiment of the invention.

In FIG. 3 *a*) and *b*) it is well visible that the gripper bar body comprises two different materials. According to the preferred embodiment shown in FIG. 3 the materials comprise a metal material (4) and a composite material (3) and the at least two different materials being at least partly arranged in a superposed manner. In the shown embodiment, the hollow structure is built by a metal material (4), and in certain areas, a composite material (3) is attached on the metal material.

Figure 3B:
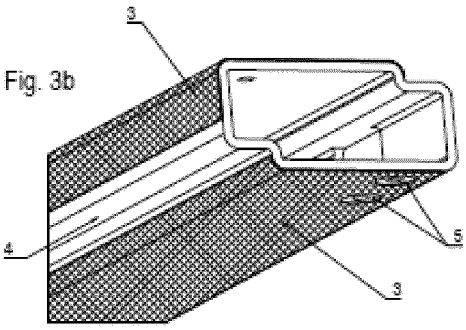

As can be seen in particular in FIG. 3*b*), the gripper bar body (1) comprises two areas of superposed materials.

According to a preferred embodiment of the invention the gripper bar body (1) is formed of Aluminum and/or Magnesium and then predefined areas are coated with aramid fiber material with a thickness of approximately 0.4 mm. Preferably this is provided by 2 layers of aramid fiber material of a thickness of 0.2 mm. The aramid fiber material is connected by gluing the two materials together, preferably by void of air. A well known example of aramid is known commercially under the name "Kevlar".

When using a thickness of composite material smaller than 0.5 mm, fixated above the metal, the main effect observed is an improvement of the abrasion resistance of the bar (independent from the fact that the materials cover one or more areas or the metal), with a minor increase in weight. The increase of the stiffness of the bar is a minor (and positive) side-effect (barely measurable with a 0.2 mm thickness). A thicker layer of the composite material is advised to obtain a significant Increase in the stiffness of the bar.

The abrasion resistance can be measured by measuring the loss of mass of the bar when exposed to a repeated scratching action. As an example, aramid fibers material has a better abrasion resistance than aluminum or magnesium.

Another positive side effect obtained by using an aramid-based composite material on the gripper bar is the ability to keep the bar in one piece in case of a catastrophic failure. This is enabled by the ability of the aramid fibers to absorb and dissipate the energy thanks to the combination of fibers having high stiffness and both high ultimate tensile and strain strength. It prevents the ejection of pieces of the bar that might be either ejected from the machine and hurt someone or causing serious damage to the machine due to the multiplication of the ejected parts.

The two areas showing the Aramid fiber material in FIG. 3*b*) are located at two in particular opposing areas of the hollow structure of gripper bar body (1) and substantially along the entire length.

Since we do not use the composite material to rigidify the bar, but for protection against hits or scratches, we do not need the composite material all around the bar, thereby gaining in production cost, complexity and production yield (even if by putting the composite material in several areas achieved positive results in rigidity), The gripper bar body, according to the shown embodiment, also comprises areas for engaging the gripper bar body (5). His can be an engagement with other parts lie for example brackets etc. or the machine, where the gripper bar will be connected to. Preferably these areas (5) are omitted from superposing the composite material. Having the metal material in the engaging area facilitates the engagement, for example, by mechanical means, like screws, etc.

The invention claimed is:

1. A gripper bar body for a gripper bar for gripping sheet material, the gripper bar body being configured to carry gripper brackets for movement between sheet gripping and sheet releasing positions, the gripper bar body comprising:

a substantially hollow structure comprising at least two different materials, the substantially hollow structure having a top wall, a bottom wall, a first side wall connecting the top wall and the bottom wall, and a second side wall connecting the top wall and the bottom wall, wherein the top wall, the bottom wall, the first side wall, and the second side wall define a cavity, and wherein at least one of the top wall or the bottom wall includes a first surface and a stepped portion that extends vertically to a second surface which is recessed with respect to the first surface and extends horizontally to connect to the first side wall or the second side wall, wherein the at least two different materials include at least a metal material and a composite material, the at least two different materials are at least partly arranged in a superposed manner, and an abrasion resistance of the composite material is larger than an abrasion resistance of the metal material.

2. The gripper bar body of claim 1, wherein the substantially hollow structure includes at least two areas having a superposed arrangement where the at least two different materials are arranged in a superposed manner, the at least two areas being at least partially separated such that the superposed arrangement is omitted between the at least two areas.

3. The gripper bar body of claim 2, wherein the at least two areas are substantially opposing areas of the substantially hollow structure.

4. The gripper bar body of claim 2, wherein the at least two areas extend substantially along an entire width of the gripper bar body.

5. The gripper bar body of claim 1, wherein the composite material is omitted from areas of the substantially hollow structure that are configured to engage the gripper bar body.

6. The gripper bar body of claim 1, wherein the metal material comprises at least one of aluminum, magnesium and/or titanium.

7. The gripper bar body of claim 1, wherein the composite material comprises an aramid fiber material.

8. The gripper bar body of claim 1, wherein the composite material comprises at least one of carbon fiber reinforced plastic, glass fiber reinforced plastic, natural fiber reinforced plastic, and/or wood fiber reinforced plastic.

9. The gripper bar body of claim 1, wherein the composite material includes at least a fiber composite material, and fibers of the fiber composite material are arranged substantially in a direction parallel a length of the gripper bar body.

10. The gripper bar body of claim 1, wherein the composite material includes at least a fiber composite material, and fibers of the fiber composite material are arranged in at least two directions.

11. The gripper bar body of claim 1, wherein the composite material is a coating, the coating having one or several layers, the one or several layers having a total thickness of less than 0.5 mm.

12. The gripper bar body of claim 2, wherein the substantially hollow structure is a substantially quadrangular shaped structure with rounded angles, and the at least two areas comprise parts of longitudinal areas of the substantially quadrangular shaped structure.

13. The gripper bar body of claim 1, wherein the composite material is attached to the metal material by gluing.

14. A gripper carriage arrangement comprising a gripper bar body according to claim 1.

15. The gripper bar body of claim 1, wherein:

the top wall and the bottom wall each includes a respective first surface and a respective stepped portion having a respective second surface, and the second surface of the top wall is provided above the first surface of the bottom wall and extends to the second side wall, and the second surface of the bottom wall is provided below the first surface of the top wall and extends to the first side wall.

16. A gripper bar body for a gripper bar for gripping sheet material, the gripper bar body being configured to carry gripper brackets for movement between sheet gripping and sheet releasing positions, the gripper bar body comprising:

a substantially hollow structure comprising a metal material, the substantially hollow structure having a top wall, a bottom wall, a first side wall connecting the top wall and the bottom wall, and a second side wall connecting the top wall and the bottom wall, wherein the top wall, the bottom wall, the first side wall, and the second side wall define a cavity, and at least one of the top wall or the bottom wall include a first surface and a stepped portion that extends vertically to a second surface which is recessed with respect to the first surface and extends horizontally to connect to the first side wall or the second side wall, and a composite material superposed on the metal material and having an abrasion resistance larger than an abrasion resistance of the metal material, wherein the composite material is omitted from at least one area of the substantially hollow structure such that the metal material is exposed.

17. The gripper bar body of claim 16, wherein:

the first side wall includes positions configured to engage with gripper brackets, and the at least one area includes the positions.

18. The gripper bar body of claim 16, wherein:

at least one of the top wall or the bottom wall includes an engagement area configured to receive a fastener, and the at least one area includes the engagement area.

19. A gripper bar body for a gripper bar for gripping sheet material, the gripper bar body being configured to carry gripper brackets for movement between sheet gripping and sheet releasing positions, the gripper bar body comprising:

a substantially hollow structure comprising a metal material, the substantially hollow structure having a top wall, a bottom wall, a first side wall connecting the top wall and the bottom wall, and a second side wall connecting the top wall and the bottom wall, wherein the top wall, the bottom wall, the first side wall, and the second side wall define a cavity, and wherein at least one of the top wall or the bottom wall includes a first surface and a stepped portion that extends vertically to a second surface which is recessed respect to the first surface and extends horizontally to connect to the first side wall or the second side wall, and only one coating of composite material superposed on the metal material, wherein an abrasion resistance of the composite material is larger than an abrasion resistance of the metal material.

20. The gripper bar body of claim 1, wherein:

the metal material comprises at least one of aluminum, magnesium and/or titanium, the composite material comprises an aramid fiber material, and the aramid fiber material is attached to an outer surface of the substantially hollow structure, wherein the outer surface is opposite to an inner surface that defines the cavity.

* * * * *